US011118838B2

(12) United States Patent
Joseph et al.

(10) Patent No.: US 11,118,838 B2
(45) Date of Patent: Sep. 14, 2021

(54) LEAF-SHAPED GEOMETRY FOR HEAT EXCHANGER CORE

(71) Applicant: Hamilton Sundstrand Corporation, Charlotte, NC (US)

(72) Inventors: Ephraim Joseph, South Windsor, CT (US); Michael Maynard, Springfield, MA (US); Michael Doe, Southwick, MA (US); Michele Hu, Manchester, CT (US); Feng Feng, South Windsor, CT (US); Ahmet T. Becene, West Simsbury, CT (US); Gabriel Ruiz, Granby, CT (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 137 days.

(21) Appl. No.: 16/711,144

(22) Filed: Dec. 11, 2019

(65) Prior Publication Data

US 2020/0263928 A1 Aug. 20, 2020

Related U.S. Application Data

(60) Provisional application No. 62/808,068, filed on Feb. 20, 2019.

(51) Int. Cl.
*F28D 1/02* (2006.01)
*F28D 1/047* (2006.01)
*F28D 1/053* (2006.01)

(52) U.S. Cl.
CPC ..... *F28D 1/0246* (2013.01); *F28D 1/0475* (2013.01); *F28D 1/05333* (2013.01); *F28D 2001/0273* (2013.01)

(58) Field of Classification Search
CPC .. F28D 1/0246; F28D 1/0475; F28D 1/05333; F28D 2001/0273; F28D 7/0041; F28D 7/1607; F28D 2001/028
(Continued)

(56) References Cited

U.S. PATENT DOCUMENTS 1,411,762 A * 4/1922 True ..... F16L 39/005 285/134.1
3,212,570 A 10/1965 Holman
(Continued)

FOREIGN PATENT DOCUMENTS

EP 3217119 A1 9/2017
WO WO2004097323 A1 11/2004
(Continued)

OTHER PUBLICATIONS

Extended European Search Report for EP Application No. 19216296.4, dated Mar. 13, 2020, 5 pages.

*Primary Examiner* — Jon T. Schermerhorn, Jr.
(74) *Attorney, Agent, or Firm* — Kinney & Lange, P.A.

(57) ABSTRACT

A core arrangement for a heat exchanger includes a first core layer disposed along a first plane and having an inlet and outlet oriented along a first axis within the first plane and a first core stage disposed in fluid communication between the inlet and the outlet. The first core stage includes a first upstream fluid intersection downstream of and adjacent the inlet and having a first inlet continuation and a first bifurcation. The first core stage further includes a first downstream fluid intersection upstream of and adjacent the outlet and having a first outlet continuation and a first recombination. A plurality of first core tubes fluidly connect the first bifurcation to the first recombination. The first core layer further includes a second core stage disposed in fluid communication between the first inlet continuation and the first outlet continuation. The second core stage includes a second upstream fluid intersection downstream of the first inlet continuation and having a second bifurcation, and a second downstream fluid intersection upstream of the first outlet continuation and having a second recombination. A plurality
(Continued)

of independent second core tubes fluidly connect the second bifurcation to the second recombination.

20 Claims, 3 Drawing Sheets

(58) Field of Classification Search
USPC ..... 165/172
See application file for complete search history.

(56) References Cited

U.S. PATENT DOCUMENTS 3,229,762 A * 1/1966 Vollhardt ..... F28F 9/182 165/157
4,058,161 A 11/1977 Trepaud
4,570,703 A 2/1986 Ringsmuth et al.
5,551,504 A * 9/1996 Zifferer ..... B21C 37/151 165/155
7,240,723 B2 7/2007 Wu et al.
9,134,072 B2 * 9/2015 Roisin ..... F28F 21/084
9,964,077 B2 * 5/2018 Neal ..... F28D 7/1607
9,976,815 B1 5/2018 Roper et al.
10,584,922 B2 * 3/2020 Herring ..... F28D 7/0016
10,746,326 B2 * 8/2020 Custer ..... B29C 64/153
2015/0140190 A1 5/2015 Cully et al.
2017/0191762 A1 7/2017 Duelser et al.
2017/0205149 A1 7/2017 Herring et al.
2017/0248372 A1 8/2017 Emo et al.
2018/0038654 A1 2/2018 Popp et al.
2018/0051934 A1 2/2018 Wentland et al.
2018/0100703 A1 4/2018 Beaver et al.
2018/0100704 A1 * 4/2018 Lewandowski ..... F28F 27/02
2018/0283794 A1 * 10/2018 Cerny ..... F28F 9/02
2018/0283795 A1 * 10/2018 Cerny ..... F28F 9/02

FOREIGN PATENT DOCUMENTS

WO WO2011115883 A2 9/2011
WO WO2016057443 A1 4/2016

* cited by examiner

LEAF-SHAPED GEOMETRY FOR HEAT EXCHANGER CORE

CROSS-REFERENCE TO RELATED APPLICATION(S)

This application claims the benefit of U.S. Provisional Application No. 62/808,068 filed Feb. 20, 2019 for "LEAF-SHAPED GEOMETRY FOR HEAT EXCHANGER CORE" by E. Joseph, M. Maynard, M. Doe, M. Hu, F. Feng, A. Bacene, and G. Ruiz.

BACKGROUND

Many aircraft heat exchangers operate at high temperatures and are subject to thermal stresses caused by thermal expansion, especially with thermal coefficient mismatch and uneven temperature distribution within the heat exchanger or with abutting components. These thermal stresses can lead to a reduction in the service life of the heat exchanger. In addition, deleterious mechanical stresses due to vibration can arise where components natural frequencies coincide significantly with engine operating frequencies. Particularly high stress regions within aircraft heat exchangers include interfaces between fluid inlets and outlets with the core section.

SUMMARY

A core arrangement for a heat exchanger includes a first core layer disposed along a first plane and having an inlet and outlet oriented along a first axis within the first plane and a first core stage disposed in fluid communication between the inlet and the outlet. The first core stage includes a first upstream fluid intersection downstream of and adjacent the inlet and having a first inlet continuation and a first bifurcation. The first core stage further includes a first downstream fluid intersection upstream of and adjacent the outlet and having a first outlet continuation and a first recombination. A plurality of first core tubes fluidly connect the first bifurcation to the first recombination. The first core layer further includes a second core stage disposed in fluid communication between the first inlet continuation and the first outlet continuation. The second core stage includes a second upstream fluid intersection downstream of the first inlet continuation and having a second bifurcation, and a second downstream fluid intersection upstream of the first outlet continuation and having a second recombination. A plurality of independent second core tubes fluidly connect the second bifurcation to the second recombination.

A heat exchanger includes a core having a core arrangement with a plurality of core layers in a stacked arrangement and disposed in a core layer plane. Each of the core layers includes an inlet and outlet oriented along a first axis within the first plane and a first core stage disposed in fluid communication between the inlet and the outlet. The first core stage includes a first upstream fluid intersection downstream of and adjacent the inlet and having a first inlet continuation and a first bifurcation. The first core stage further includes a first downstream fluid intersection upstream of and adjacent the outlet and having a first outlet continuation and a first recombination. A plurality of first core tubes fluidly connect the first bifurcation to the first recombination. The first core layer further includes a second core stage disposed in fluid communication between the first inlet continuation and the first outlet continuation. The second core stage includes a second upstream fluid intersection downstream of the first inlet continuation and having a second bifurcation, and a second downstream fluid intersection upstream of the first outlet continuation and having a second recombination. A plurality of independent second core tubes fluidly connect the second bifurcation to the second recombination.

DETAILED DESCRIPTION

A heat exchanger with improved performance under thermal and vibrational stresses is disclosed herein. The heat exchanger includes a core having multiple, planar core layers in a stacked configuration. Individual core layers can include a number of tubular flow paths concentrically arranged to give the core layer a leaf-like planar geometry with improved thermal and mechanical properties. The core can be additively manufactured to achieve varied tubular dimensions (e.g., diameter, wall thicknesses, curvature, etc.), which allows for the manufacture of a heat exchanger specifically tailored for a desired operating environment.

Figure 1:
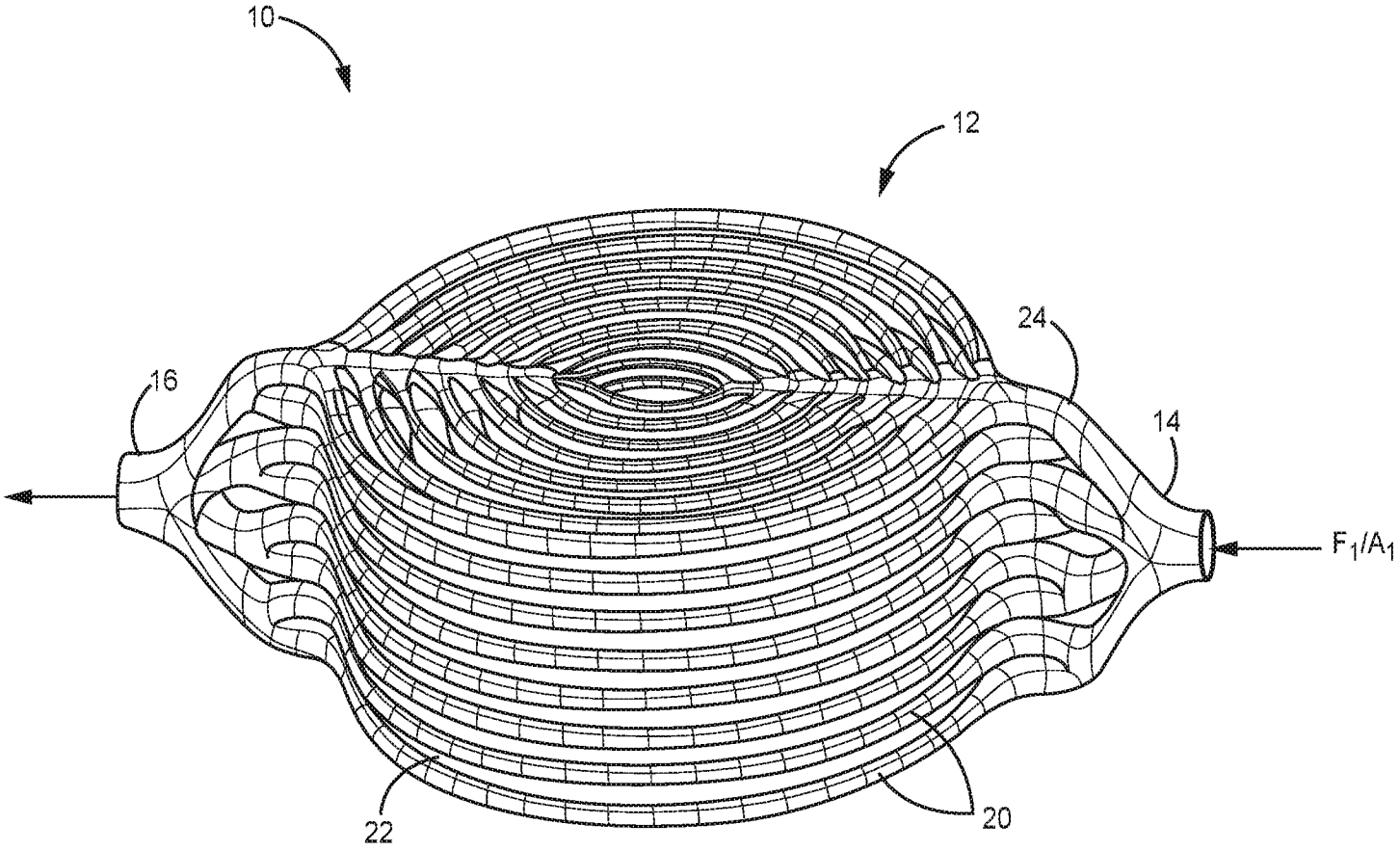
FIG. 1 is perspective view of a layered core arrangement for a heat exchanger.
Figure 2:
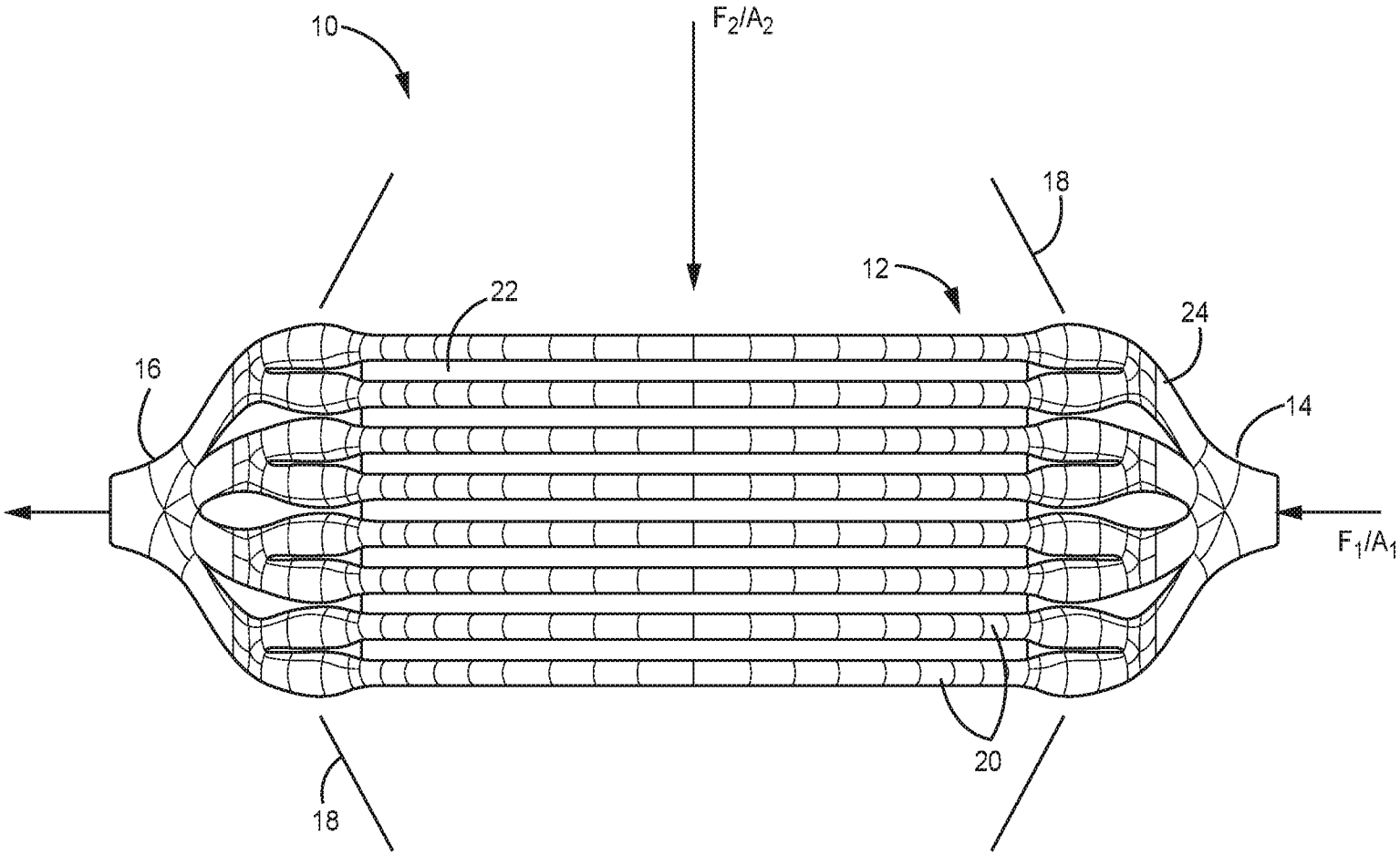
FIG. 2 is a side view of the layered core arrangement of FIG. 1 with additional fluid ducting schematically shown.

FIGS. 1 and 2 are perspective and side views, respectively, of heat exchanger 10. As shown, heat exchanger 10 includes core 12 disposed between inlet header 14 and outlet header 16. In operation of heat exchanger 10, a first fluid $F_1$ can be provided to inlet header 14, flow through core 12, and exit through outlet header 16. First fluid $F_1$ flows along a first flow axis $A_1$ at inlet header 14 and outlet header 16. FIG. 2 additionally shows a second fluid $F_2$ flowing across core 12 along second fluid axis $A_2$ via second fluid ducts 18, which can, in an alternative embodiment, be omitted. First fluid $F_1$ can be a relatively hot fluid, having a higher temperature than fluid $F_2$, which can be a relatively cool fluid, but the designations can be reversed in alternative embodiments. Further, heat exchanger 10, as shown, is arranged as a cross-flow heat exchanger, such second fluid axis $A_2$ is generally perpendicular to first fluid axis $A_1$. In other embodiments, however, second fluid $F_2$ can flow in other directions. In one such embodiment, heat exchanger 12 can have a counter-flow configuration in which axes $A_1$ and $A_2$ are parallel with fluids $F_1$ and $F_2$ flowing in opposite directions.

Core 12 includes a plurality of core layers 20 stacked along axis $A_2$. Core 12 can further include connecting elements/vanes 22 disposed between adjacent core layers 20. As shown in FIGS. 1 and 2, vanes 22 are generally solid structures occupying the space (extending parallel to axis $A_2$) between adjacent core layers 20. This helps create distinct flow passages for second fluid $F_2$, and can also provide increased core stiffness. In an alternative embodiment, vanes 22 can instead be arranged as discrete structures (i.e., ribs) separate from and positioned between adjacent core layers 20, or extending from individual core layers 20, and can alternatively or additionally be omitted between certain adjacent core layers 20. The distinct flow passages created by vanes 22 constrain flow of second fluid $F_2$, allowing for more uniform flow distribution. The stiffness added by vanes 22 raises the natural vibrational frequencies of core 12 and heat exchanger 10 as a whole, avoiding harmful resonance conditions wherein these natural frequencies could otherwise coincide with (lower) engine operating frequencies.

Each core layer 20 is in fluid communication with inlet header 14 and outlet header 16 such that each core layer 20 can receive a portion of the flow of first fluid $F_1$. Inlet header 14 and outlet header 16 have a branched configuration and are therefore scalable to fluidly connect to one or more core layers by the addition/omission of branches 24. The branched configuration can for example, exhibit a fractal geometry, with sequential branched stages and intervening bifurcations.

Figure 3:
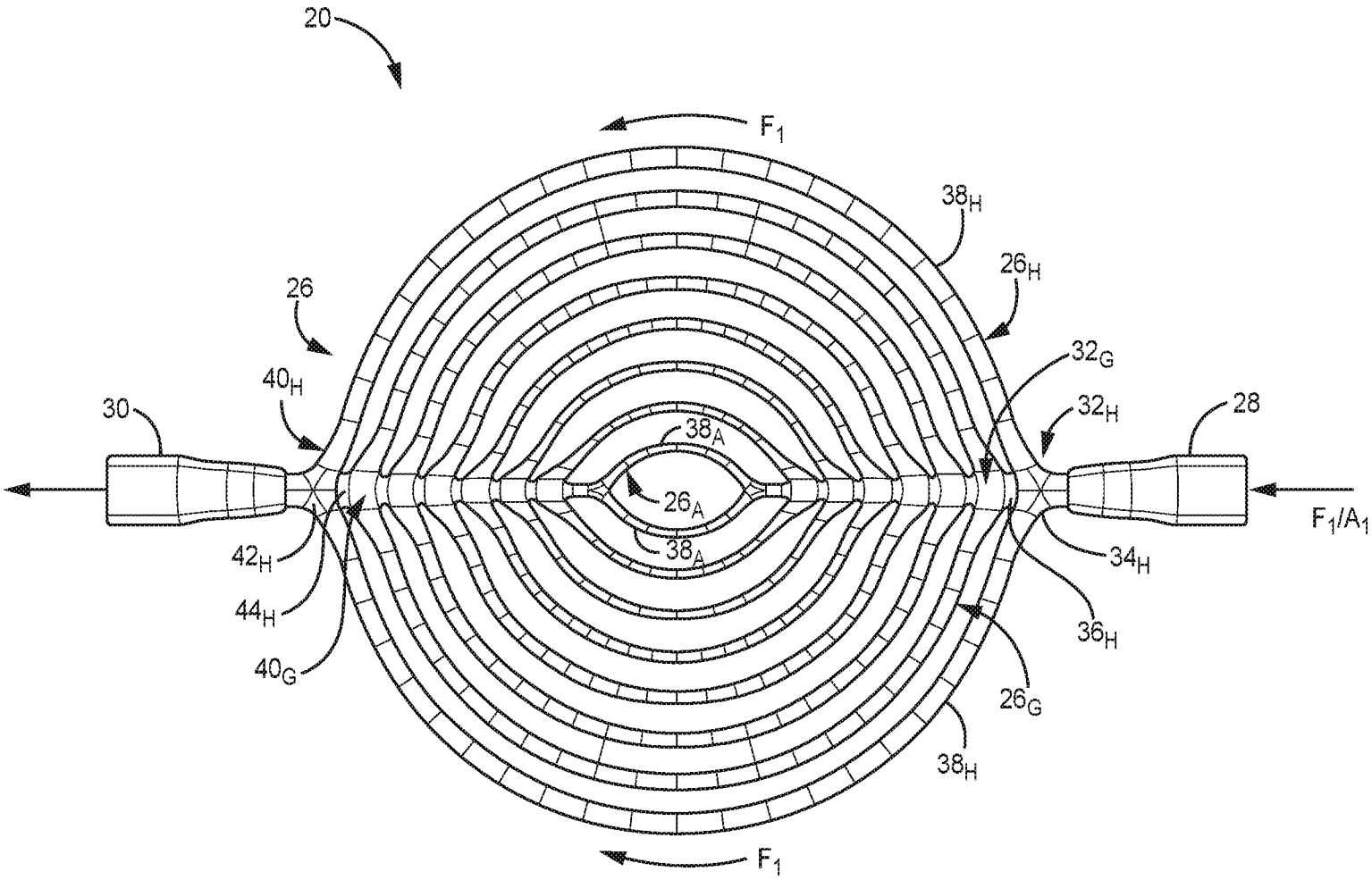
FIG. 3 is a plan view showing a single layer belonging to the layered core arrangement of FIGS. 1 and 2.

FIG. 3 is a plan view of an individual core layer 20 of core 12. Core layer 20 is shown as a substantially planar structure that can include a plurality of concentrically arranged tubular core stages 26 disposed between inlet 28 and outlet 30. More specifically, core layer 20 includes core stages $\mathbf{26}_A$-$\mathbf{26}_H$ (not all labeled in FIG. 3) in a direction of the concentrically innermost to the concentrically outermost core stage 26. In an alternative embodiment, core layer 20 can include more or fewer core stage 26 depending on factors such as spatial constraints and flow requirements. Although the present disclosure presents core layer 20 as a planar layer, some embodiments of the present heat exchanger design can include core layers that are curved, bowed, or that otherwise deviate from a strictly planar geometry.

Core stage $\mathbf{26}_H$, the outermost core stage shown in FIG. 3, includes a fluid intersection $\mathbf{32}_H$ proximate and downstream of inlet 28 (with respect to the flow of fluid $F_1$) fluidly connecting core stage $\mathbf{26}_H$ with inlet 28, concentrically inner core stages 26, and outlet 30. Fluid intersection $\mathbf{32}_H$ includes bifurcation $\mathbf{34}_H$ and inlet continuation portion $\mathbf{36}_H$. Bifurcation $\mathbf{34}_H$ allows a portion of first fluid $F_1$ to flow into core tubes $\mathbf{38}_H$, which are shown as arcuate and symmetrically disposed in the plane of core layer 20 on either side of first axis $A_1$. More generally, core tubes $\mathbf{38}_H$ (and other core tubes, as described hereinafter) are arranged concentrically with other core tubes. Continuation portion $\mathbf{36}_H$ allows a portion of first fluid $F_1$ to flow along axis $A_1$ into fluid intersection $\mathbf{32}_G$ of the adjacent and concentrically inner core stage $\mathbf{26}_G$. Core stage $\mathbf{26}_H$ further includes fluid intersection $\mathbf{40}_H$ downstream of fluid intersection $\mathbf{32}_H$. Core tubes $\mathbf{38}_H$ join fluid intersection $\mathbf{40}_H$ at recombination $\mathbf{42}_H$ to fluidly connect fluid intersections $\mathbf{32}_H$ and $\mathbf{40}_H$. Fluid intersection $\mathbf{40}_H$ further includes outlet continuation portion $\mathbf{44}_H$ which fluidly connects fluid intersection $\mathbf{40}_H$ and fluid intersection 40G of the adjacent and concentrically inner core stage $\mathbf{26}_G$.

Each core tube $\mathbf{38}_A$-$\mathbf{38}_H$ is mechanically independent from other core tubes, and is joined to other components of heat exchanger 10 only at corresponding intersections at either end of the respective core tube (and via vanes 22, in some embodiments). The ability of each core tube to bend independently under thermal loads greatly improves compliance of heat exchanger 10 as a whole, along fluid axis $A_1$. The curvature of core tubes $\mathbf{38}_A$-$\mathbf{38}_H$ (substantially circular in the illustrated embodiment) provides a degree of stiffness in the plane of each core stage, transverse to fluid axis $A_1$, which can drive the natural vibrational modes of the core along this dimension out of (lower) frequency bands corresponding to engine operating frequencies.

As shown in FIG. 3, concentrically inner core stages $\mathbf{26}_A$-$\mathbf{26}_G$ have substantially similar flow structures (e.g., fluid intersections, bifurcations, core tubes, continuations, and recombinations) to those described with respect to core stage $\mathbf{26}_H$, scaled according to concentric location within core layer 20. For example, core tubes 38 of a particular core stage 26 are generally longer than the core tubes 38 of a concentrically inner core stage 26, such that the flow path of first fluid $F_1$ is longer in the outer stages 26 as compared to the inner stages 26. In the embodiment shown, core layer 20 is further configured such that the radius of core tubes 38 of the corresponding core stage $\mathbf{26}_A$-$\mathbf{26}_H$ increases in a direction of the concentrically innermost to the concentrically outermost core stage 26. This graduation of tube radii from larger at concentrically outer stages to smaller at concentrically inner stages generates an optimal flow condition to alleviate turbulent flows and prevent fluid stagnation, therefore reducing pressure drop across core layer 20. In some embodiments, wall thicknesses of core tubes 38 can also be varied among core stages 26 to further enhance the thermal and mechanical properties of core layer 20.

The components of heat exchanger 10 can be formed partially or entirely by additive manufacturing. For metal components (e.g., Inconel, aluminum, titanium, etc.) exemplary additive manufacturing processes include powder bed fusion techniques such as direct metal laser sintering (DMLS), laser net shape manufacturing (LNSM), electron beam manufacturing (EBM), to name a few, non-limiting examples. For polymer or plastic components, stereolithography (SLA) can be used. Additive manufacturing is particularly useful in obtaining unique geometries (e.g., varied core tube radii, arcuate core tubes, branched inlet and outlet headers) and for reducing the need for welds or other attachments (e.g., between inlet header 14 and core layers 20). However, other suitable manufacturing process can be used. For example, header and core elements can in some embodiments be fabricated separately, and joined via later manufacturing steps.

The disclosed core arrangement offers improved thermal and mechanical properties. The curved geometry and tailored radii of core tubes 38 reduces pressure drop across each core layer 20. Curved core tubes also provide increased compliance along the first axis $F_1$ to allow for thermal growth of the core layer. Alternative embodiments of core 12 can include core layers 20 having other substantially planar geometries with non-circular (e.g., oval, elliptical, s-shaped) tube curvature, and/or having non-uniform shapes and/or sizes. In addition to aerospace applications, the disclosed core arrangement can be used generally in other transportation industries, as well as industrial applications.

Discussion of Possible Embodiments

The following are non-exclusive descriptions of possible embodiments of the present invention.

A core arrangement for a heat exchanger includes a first core layer disposed along a first plane and having an inlet and outlet oriented along a first axis within the first plane and a first core stage disposed in fluid communication between the inlet and the outlet. The first core stage includes a first upstream fluid intersection downstream of and adjacent the inlet and having a first inlet continuation and a first bifurcation. The first core stage further includes a first downstream fluid intersection upstream of and adjacent the outlet and having a first outlet continuation and a first recombination. A plurality of first core tubes fluidly connect the first bifurcation to the first recombination. The first core layer further includes a second core stage disposed in fluid communication between the first inlet continuation and the first outlet continuation. The second core stage includes a second upstream fluid intersection downstream of the first inlet continuation and having a second bifurcation, and a second downstream fluid intersection upstream of the first outlet continuation and having a second recombination. A plurality of independent second core tubes fluidly connect the second bifurcation to the second recombination.

The core arrangement of the preceding paragraph can optionally include, additionally and/or alternatively, any one or more of the following features, configurations and/or additional components:

In the above core arrangement, the first inlet continuation and the first outlet continuation can be oriented along the first axis.

In any of the above core arrangements, the plurality of independent first and second core tubes can be arcuate tubular members disposed within the first plane.

Any of the above core arrangements can further include a third core stage disposed in fluid communication between the first inlet continuation and the first outlet continuation. The third core stage can include a third upstream fluid intersection downstream of and adjacent the first inlet continuation and having a third bifurcation and a second inlet continuation upstream of and fluidly connected to the second upstream fluid intersection. The third core stage can further include a third downstream fluid intersection upstream of and adjacent the first outlet continuation and having a third recombination and a second outlet continuation downstream of and fluidly connected to the downstream fluid intersection. A plurality of independent third core tubes can fluidly connect the third bifurcation to the third recombination.

In any of the above core arrangements, the plurality of independent first, second, and third core tubes can be arranged substantially concentrically within the first plane.

In any of the above core arrangements, the plurality of independent first core tubes can have a first diameter, the plurality of independent second core tubes can have a second diameter, and the plurality of independent third core tubes can have a third diameter.

In any of the above core arrangements, the first diameter can be greater than the second and third diameters.

In any of the above core arrangements, the first core layer can be symmetrical about the first axis.

Any of the above core arrangements can further include a second core layer disposed along a second plane adjacent and parallel to the first plane. The second core layer can include a second inlet oriented along the first axis within the second plane, a second outlet oriented along the first axis, a first core stage of the second core layer similar to the first core stage of the first core layer, and a second core stage of the second core layer similar to the second core stage of the first core layer.

In any of the above core arrangements, the first and second core layers can be formed from one of a metallic and a plastic material.

Any of the above core arrangements can include a plurality of connecting elements disposed between and physically contacting each of the first a second core layers.

A heat exchanger includes a core having a core arrangement with a plurality of core layers in a stacked arrangement and disposed in a core layer plane. Each of the core layers includes an inlet and outlet oriented along a first axis within the first plane and a first core stage disposed in fluid communication between the inlet and the outlet. The first core stage includes a first upstream fluid intersection downstream of and adjacent the inlet and having a first inlet continuation and a first bifurcation. The first core stage further includes a first downstream fluid intersection upstream of and adjacent the outlet and having a first outlet continuation and a first recombination. A plurality of first core tubes fluidly connect the first bifurcation to the first recombination. The first core layer further includes a second core stage disposed in fluid communication between the first inlet continuation and the first outlet continuation. The second core stage includes a second upstream fluid intersection downstream of the first inlet continuation and having a second bifurcation, and a second downstream fluid intersection upstream of the first outlet continuation and having a second recombination. A plurality of independent second core tubes fluidly connect the second bifurcation to the second recombination.

The heat exchanger of the preceding paragraph can optionally include, additionally and/or alternatively, any one or more of the following features, configurations and/or additional components:

The above heat exchanger can further include a third core stage disposed in fluid communication between the first inlet continuation and the first outlet continuation. The third core stage can include a third upstream fluid intersection downstream of and adjacent the first inlet continuation and having a third bifurcation and a second inlet continuation upstream of and fluidly connected to the second upstream fluid intersection. The third core stage can further include a third downstream fluid intersection upstream of and adjacent the first outlet continuation and having a third recombination and a second outlet continuation downstream of and fluidly connected to the downstream fluid intersection. A plurality of independent third core tubes can fluidly connect the third bifurcation to the third recombination.

In any of the above heat exchangers, the plurality of independent first, second, and third core tubes can be arranged substantially concentrically within the core layer plane.

Any of the above heat exchangers can further include a plurality of connecting elements disposed between and physically contacting one of the plurality of core layers and an adjacent one of the plurality of core layers.

In any of the above heat exchangers, each of the plurality of core layers can be configured to receive a first fluid along the first axis.

In any of the above heat exchangers, each of the plurality of core layers can be fluidly connected to a first fluid inlet header and a first fluid outlet header.

In any of the above heat exchangers, each of the first fluid inlet header and the first fluid outlet header can be a bifurcated header having fractal geometry.

In any of the above heat exchangers, the core can be configured to receive a flow of a second fluid along a second axis perpendicular to the first axis.

In any of the above heat exchangers, a temperature of the second fluid can be lower than a temperature of the first fluid.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A core arrangement for a heat exchanger, the core arrangement comprising:

a first core layer disposed along a first plane, and comprising:

an inlet oriented along a first axis within the first plane;
an outlet oriented along the first axis;
a first core stage disposed in fluid communication between the inlet and the outlet, the first core stage comprising:
a first upstream fluid intersection downstream of and adjacent the inlet, and comprising a first inlet continuation and a first bifurcation;
a first downstream fluid intersection upstream of and adjacent the outlet, and comprising a first outlet continuation and a first recombination; and
a plurality of independent first core tubes fluidly connecting the first bifurcation to the first recombination; and
a second core stage disposed in fluid communication between the first inlet continuation and the first outlet continuation, the second core stage comprising:
a second upstream fluid intersection downstream of the first inlet continuation, and comprising a second bifurcation;
a second downstream fluid intersection upstream of the first outlet continuation, and comprising a second recombination; and
a plurality of independent second core tubes fluidly connecting the second bifurcation to the second recombination.

2. The core arrangement of claim 1, wherein the first inlet continuation and the first outlet continuation are oriented along the first axis.

3. The core arrangement of claim 2, wherein the plurality of independent first and second core tubes are arcuate tubular members disposed within the first plane.

4. The core arrangement of claim 3 and further comprising a third core stage disposed in fluid communication between the first inlet continuation and the first outlet continuation, the first core stage comprising:
a third upstream fluid intersection downstream of and adjacent the first inlet continuation, and comprising a third bifurcation and a second inlet continuation upstream of and fluidly connected to the second upstream fluid intersection;
a third downstream fluid intersection upstream of and adjacent the first outlet continuation, and comprising a third recombination and a second outlet continuation downstream of and fluidly connected to the second downstream fluid intersection; and
a plurality of independent third core tubes fluidly connecting the third bifurcation to the third recombination.

5. The core arrangement of claim 4, wherein the plurality of independent first, second, and third core tubes are arranged substantially concentrically within the first plane.

6. The core arrangement of claim 5, wherein the plurality of independent first core tubes have a first diameter, the plurality of independent second core tubes have a second diameter, and the plurality of independent third core tubes have a third diameter.

7. The core arrangement of claim 6, wherein the first diameter is greater than the second and third diameters.

8. The core arrangement of claim 4, wherein the first core layer is symmetrical about the first axis.

9. The core arrangement of claim 1 and further comprising: a second core layer disposed along a second plane adjacent and parallel to the first plane, the second core layer comprising:
an second inlet oriented along the first axis within the second plane;
a second outlet oriented along the first axis;
a first core stage of the second core layer similar to the first core stage of the first core layer; and
a second core stage of the second core layer similar to the second core stage of the first core layer.

10. The core arrangement of claim 9, wherein the first and second core layers are formed from one of a metallic material and a plastic material.

11. The core arrangement of claim 9 and further comprising: a plurality of connecting elements disposed between and physically contacting each of the first a second core layers.

12. A heat exchanger comprising:
a core having a core arrangement comprising a plurality of core layers in a stacked arrangement, each of the plurality of core layers disposed in a core layer plane, each of the plurality of core layers comprising:
an inlet oriented along a first axis within the core layer plane;
an outlet oriented along the first axis;
a first core stage disposed in fluid communication between the inlet and the outlet, the first core stage comprising:
a first upstream fluid intersection downstream of and adjacent the inlet, and comprising a first inlet continuation and a first bifurcation;
a first downstream fluid intersection upstream of and adjacent the outlet, and comprising a first outlet continuation and a first recombination; and
a plurality of independent first core tubes fluidly connecting the first bifurcation to the first recombination; and
a second core stage disposed in fluid communication between the first inlet continuation and the first outlet continuation, the second core stage comprising:
a second upstream fluid intersection downstream of the first inlet continuation, and comprising a second bifurcation;
a second downstream fluid intersection upstream of the first outlet continuation, and comprising a second recombination; and
a plurality of independent second core tubes fluidly connecting the second bifurcation to the second recombination.

13. The heat exchanger of claim 12 and further comprising a third core stage disposed in fluid communication between the first inlet continuation and the first outlet continuation, the third core stage comprising:
a third upstream fluid intersection downstream of and adjacent the first inlet continuation, and comprising a third bifurcation and a second inlet continuation upstream of and fluidly connected to the second upstream fluid intersection;
a third downstream fluid intersection upstream of and adjacent the first outlet continuation, and comprising a third recombination and a second outlet continuation downstream of and fluidly connected to the second downstream fluid intersection; and
a plurality of independent third core tubes fluidly connecting the third bifurcation to the third recombination.

14. The heat exchanger of claim 13, wherein the plurality of independent first, second, and third core tubes are arranged substantially concentrically within the core layer plane.

15. The heat exchanger of claim 12 and further comprising: a plurality of connecting elements disposed between and physically contacting one of the plurality of core layers and an adjacent one of the plurality of core layers.

16. The heat exchanger of claim 12, wherein each of the plurality of core layers is configured to receive a first fluid along the first axis.

17. The heat exchanger of claim 16, wherein each of the plurality of core layers is fluidly connected to a first fluid inlet header and a first fluid outlet header.

18. The heat exchanger of claim 17, wherein each of the first fluid inlet header and the first fluid outlet header is a bifurcated header having fractal geometry.

19. The heat exchanger of claim 16, wherein the core is configured to receive a flow of a second fluid along a second axis perpendicular to the first axis.

20. The heat exchanger of claim 19, wherein a temperature of the second fluid is lower than a temperature of the first fluid.

* * * * *